US010102987B1

(12) United States Patent
Alexander et al.

(10) Patent No.: US 10,102,987 B1
(45) Date of Patent: Oct. 16, 2018

(54) KEYBOARD SWITCH WITH A CAM HAVING A CURVED PROFILE TO PROMOTE A SMOOTH TACTILE RESPONSE

(71) Applicant: Massdrop Group, Inc., San Francisco, CA (US)

(72) Inventors: Jacob Alexander, San Jose, CA (US); Brandon Muzzin, Tucson, AZ (US)

(73) Assignee: MASSDROP GROUP, INC., San Francisco, CA (US)

( * ) Notice: Subject to any disclaimer, the term of this patent is extended or adjusted under 35 U.S.C. 154(b) by 0 days.

(21) Appl. No.: 15/596,488

(22) Filed: May 16, 2017

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/78*** | (2006.01) |

(Continued)

(52) U.S. Cl.
CPC ..... *H01H 13/78* (2013.01); *H01H 13/85* (2013.01); *H01H 13/86* (2013.01); *H01H 2233/07* (2013.01)

(58) Field of Classification Search
CPC ..... H01H 2221/008; H01H 2221/064; H01H 2221/09; H01H 2223/044; H01H 2225/02; H01H 2237/004; H01H 3/00; H01H 3/02; H01H 3/12; H01H 5/00; H01H 5/04; H01H 5/18; H01H 2205/00; H01H 2205/014; H01H 2205/018; H01H 2221/00; H01H 2233/00; H01H 2233/002; H01H 9/02; H01H 13/00; H01H 13/50; H01H 13/62; H01H 13/66; H01H 13/70; H01H 13/7006; H01H 13/78; H01H 13/85; H01H 13/86; H01H 2003/00; H01H 2003/12; H01H 2013/00; H01H 2021/00; H01H 2215/006;
(Continued)

(56) References Cited

U.S. PATENT DOCUMENTS 3,676,626 A * 7/1972 Mitchell ..... H01H 13/06 200/302.2
3,856,998 A * 12/1974 Sims, Jr. ..... H01H 13/52 200/5 A
4,467,160 A 8/1984 Murmann et al.
(Continued)

FOREIGN PATENT DOCUMENTS

WO WO2017/0028702 2/2017

*Primary Examiner* — Anthony R Jimenez
(74) *Attorney, Agent, or Firm* — Steven M. Greenberg, Esq.; Shutts & Bowen LLP

(57) ABSTRACT

A keyboard switch for a keyboard includes a base secured to a plunger that reciprocates with respect to the base and is biased away from the base. An electrical contact assembly is positioned within a cavity defined by the base and the plunger. The electrical contact assembly remains in an electrically open state when the plunger is furthest from the base, but the electrical contact assembly enters an electrically closed state when the plunger is longitudinally moved downwardly by force towards the base. In this regard, a cam protruding from a side portion of a body of the plunger has a profile surface that contacts the electrical contact assembly as the plunger is longitudinally moved towards the base. A curved profile of the cam that incorporates a concave arc uniquely changes the amount of force experienced by the typist at different points of the downward motion of the plunger.

11 Claims, 3 Drawing Sheets

(51) Int. Cl.
*H01H 13/86* (2006.01)
*H01H 13/85* (2006.01)

(58) Field of Classification Search
CPC . H01H 2239/006; H03K 17/975; H03K 17/94
USPC ..... 200/408, 409, 412, 441, 443, 451, 467, 200/510, 540, 573, 254, 337, 341, 345, 200/5 A, 52 R, DIG. 1, 159 B, 600, 276.1, 200/534; 361/288; 341/33
See application file for complete search history.

(56) References Cited

U.S. PATENT DOCUMENTS

| | | | | |
|---|---|---|---|---|
| 4,584,444 | A | 4/1986 | Nagashima et al. | |
| 2006/0000699 | A1* | 1/2006 | Sasaki ..... | H01H 13/023 200/341 |
| 2017/0062152 | A1 | 3/2017 | Wu | |
| 2017/0125189 | A1 | 5/2017 | Domzalski et al. | |

* cited by examiner

KEYBOARD SWITCH WITH A CAM HAVING A CURVED PROFILE TO PROMOTE A SMOOTH TACTILE RESPONSE

BACKGROUND OF THE INVENTION

Field of the Invention

The present invention relates to the keyboard switches and more particularly, to a mechanical keyboard switch.

Description of the Related Art

In computing, a computer keyboard is a typewriter-style device which uses an arrangement of buttons or keys to act as a mechanical lever or electronic switch. Keyboards have become the main input device for computers. Keyboards use a variety of switch technologies. Generally, keyboards use either capacitive, membrane or mechanical switches. A mechanical switch operates through the mechanically actuated contacting of two metal components so as to complete a circuit. The computer then detects the completion of the circuit and registers a keystroke. Unlike a mechanical switch, a capacitive switch does not physically complete a circuit upon actuation. Instead, current constantly flows through all parts of the key matrix and, as the switch becomes actuated, two metallic plates move closer to one another such that the amount of current flowing through the matrix changes. The change in current flow is then detected and interpreted as a keystroke.

There are several common types of mechanical switches, each providing a different level of audible and tactile response—the sounds and sensations that typing creates. Mechanical key switches generally include rubber dome, membrane, metal contact switches and foam element switches. Rubber dome switches utilize small, flexible rubber domes, each with a hard carbon center such that when a key incorporating the rubber dome becomes depressed, a plunger on the bottom of the key pushes down against the dome, causing the carbon center to press against a hard, flat surface beneath the key matrix. So long as the key remains held, the carbon center completes the circuit. When the key is released, the rubber dome springs back to its original shape, forcing the key back up to its at-rest position. Rubber dome switch keyboards are inexpensive, demonstrate good tactile response and are fairly resistant to spills and corrosion because of the rubber layer covering the key matrix.

Membrane keyboards use a continuous membrane that stretches from one end of a keyboard to another. A pattern printed in the membrane completes the circuit when a key in the membrane becomes depressed. As most membrane keyboards use a flat surface printed with representations of each key rather than keycaps affixed to movable keys, membrane keyboards are known to lack good tactile and audible response. Finally, metal contact and foam element keyboards incorporate spring-loaded switches each with a strip of metal disposed at a bottom of a plunger of each switch as can be seen in U.S. Pat. No. 4,467,160 to Murmann et al. As can be seen in reference to Murmann, a switch key may have a base which is slidingly engaged with a plunger body. The plunger body carries fixed angle inclined cams which control the flexing of contactors to make and break conductive connections with adjacent stationary contacts while a coil spring biases the pushbutton upwardly to its rest position. The stationary contacts and associated overlying cams are interlocked when the pushbutton is depressed to provide a relatively low switch profile with respect to the length of the key stroke.

Both metal contact and foam element switches demonstrate good tactile and audible response and are inexpensive to produce. However, it is well known that the contacts of metal contact and foam element switches tend to wear out or corrode faster than other types of keyboard switches—especially capacitive switches. As well, most tactile feedback systems for metal contact and foam element switches rely upon the resistance of a spring the extent of which is determined by a spring coefficient of the spring, and the sharp force impulse at the completion of a keystroke. However, a sharp force impulse—essentially the sensation of an immediate response resulting from a collision of two rigid objects—when typing for long periods of time, can be fatiguing to the user as the muscles in the user's fingers cannot react fast enough to tense and subsequently relax in order to accommodate the sharp force impulse.

BRIEF SUMMARY OF THE INVENTION

The present invention addresses the deficiencies of mechanical switches in computer keyboards and provides a novel and non-obvious mechanical switch for a keyboard that provides clear tactile feedback while preventing quick instantaneous force changes during the depression of the switch resulting in a reduction in an amount of fatigue experienced by a typist utilizing a keyboard of such switches over long periods of time. In accordance with an embodiment of the invention, a keyboard switch includes a plunger secured to a base and adapted to longitudinally move towards the base from an open position to a closed position in which a portion of the plunger drives completion an electrical circuit of a keyboard matrix. The plunger has a body, a cross mount for a key top extending from a top surface of a top portion of the body, a spring guide protruding downwardly from a bottom surface of the top portion of the body and a recess defined within an interior portion of the body adjacent to the spring guide.

The base has at least an upstanding sleeve extending upwardly from a top surface of a bottom portion of the base and receiving a distal end of the spring guide, a metallic stationary contact that includes a top portion upwardly protruding from the top surface of the bottom portion of base and a lead downwardly protruding through the bottom portion of the base and extending from a bottom surface of the bottom portion of base and a flexible electrical contactor extending from the top surface of the bottom portion of the base into the recess of the plunger and positioned within the recess proximate to the top portion of the stationary contact. Finally, the switch includes a coil spring coiled about an exterior surface of both the spring guide and also the upstanding sleeve and resisting downward longitudinal movement of the plunger and promoting upward longitudinal movement of the plunger, The plunger further includes at least one cam extending horizontally from a primary side portion of the body. The cam demonstrates a curved profile sloping outwardly from the body at at least one acute angle relative to the primary side portion of the body to a tactile peak at a peak distance from the primary side portion of the body, and then inwardly from the tactile peak at a constantly changing obtuse angle relative to the primary side portion of the body to a position of no angle relative to the primary side portion of the body, and then outwardly from the position of no angle relative to the primary side portion of the body at a constantly changing acute angle relative to the primary side portion of the body to an end position beyond the bottom surface of the base and then then inwardly towards an interior portion of the bottom surface of the base so as to define a tail, a portion of the curved profile between the tactile peak and the tail defining an arc. In this regard, the curved profile contacts the flexible electrical contactor as the plunger longitudinally moves to the closed position and in contacting the flexible electrical contactor, driving the flexible electrical contactor towards the stationary electrical contact until the plunger is at the closed position, during which the flexible electrical contactor continuously contacts the stationary electrical contact.

In one aspect of the embodiment, the base is secured to the plunger with hook arms snapping the base into engagement with shoulders formed within grooves of the body of the plunger. In another aspect of the embodiment, the flexible electrical contactor is a U-shaped flexible electrical contactor enveloping the top portion of the stationary contact. In yet another aspect of the embodiment, the plunger includes two primary cams extending horizontally in parallel to one another from the primary side portion of the body, each with the curved profile and both cooperatively driving different portions of the flexible electrical contactor towards the stationary electrical contact until the plunger is at the closed position. Finally, in even yet another aspect of the embodiment, an additional flexible electrical contactor is provided adjacent to an additional stationary contact. In this regard, the plunger includes two additional cams extending horizontally in parallel to one another from an opposite side portion of the body relative from the primary side portion, each with the curved profile and both cooperatively driving different portions of the additional flexible electrical contactor towards the additional stationary electrical contact until the plunger is at the closed position.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Embodiments of the invention provide for a keyboard switch. The keyboard switch includes a base secured to a plunger that reciprocates with respect to the base, but that is biased away from the base. An electrical contact assembly is positioned within a cavity defined by the base and the plunger when the base is secured to the plunger. The electrical contact assembly remains in an electrically open state when the plunger is furthest from the base in an open position, but the electrical contact assembly enters an electrically closed state when the plunger is longitudinally moved downwardly by force towards the base. In this regard, a cam protruding from a side portion of a body of the plunger has a profile surface that contacts the electrical contact assembly as the plunger is longitudinally moved towards the base. A curved profile of the cam that incorporates a concave arc uniquely changes the amount of force experienced by the typist at different points of the downward motion of the plunger. In this way, superior tactile feedback is experienced by the typist relative to that of a traditional keyboard switch.

Figure 1A:
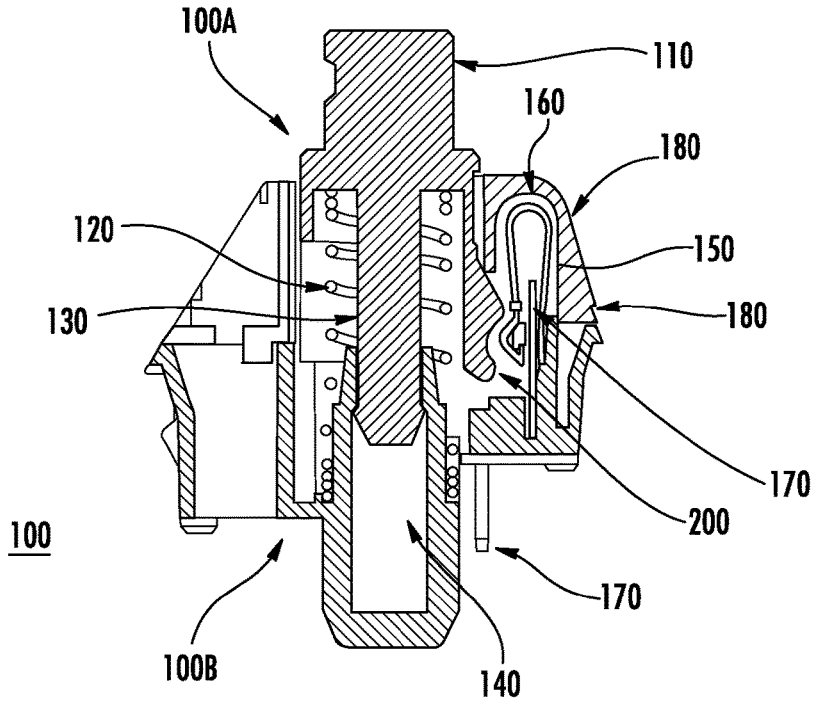
FIG. 1A is a side cut-away view of a keyboard switch with a cam having a curved profile to promote a smooth tactile response.

In further illustration, FIG. 1A is a side cut-away view of a keyboard switch with a cam having a curved profile to promote a smooth tactile response. As shown in FIG. 1A, a keyboard switch 100 includes a plunger 100A fastened to a base 100B and that is adapted to longitudinally move towards the base 100A from an open position to a closed position in which a portion of the plunger drives completion an electrical circuit of a keyboard matrix of a keyboard (not shown) for which the switch 100 is one of many switches. The plunger 100A has a body 180, a cross mount 110 for a key top extending from a top surface of a top portion of the body 180, a spring guide 130 protruding downwardly from a bottom surface of the top portion of the body 180 and a recess 160 defined within an interior portion of the body 180 adjacent to the spring guide 130.

The base 100B has at least an upstanding sleeve 140 extending upwardly from a top surface of a bottom portion of the base 100B that receives a distal end of the spring guide 130. The base 100B also has a metallic stationary contact 170 that has a top portion upwardly protruding from the top surface of the bottom portion of base 100B and a lead downwardly protruding through the bottom portion of the base 100B and extending from a bottom surface of the bottom portion of base 100B and a flexible electrical contactor 150 extending from the top surface of the bottom portion of the base 100B into the recess 160 of the plunger 100A and positioned within the recess 100A proximate to the top portion of the stationary contact 170. As well, a coil spring 120 is coiled about an exterior surface of both the spring guide 130 and also the upstanding sleeve 140 so as to resist the downward longitudinal movement of the plunger 100A and so as to promote the upward longitudinal movement of the plunger 100A.

Figure 1B:
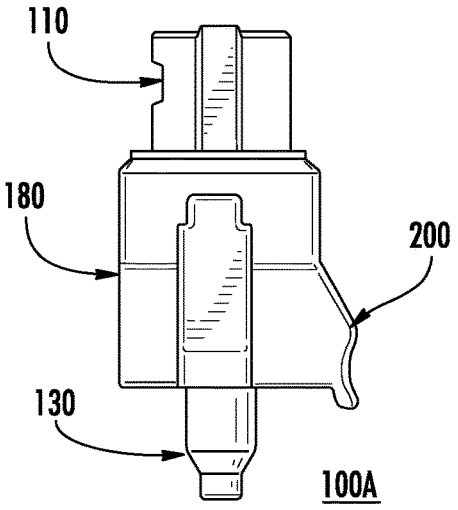
FIG. 1B is a side view of a plunger of the keyboard switch of FIG. 1A illustrating a curved profile.
Figure 2:
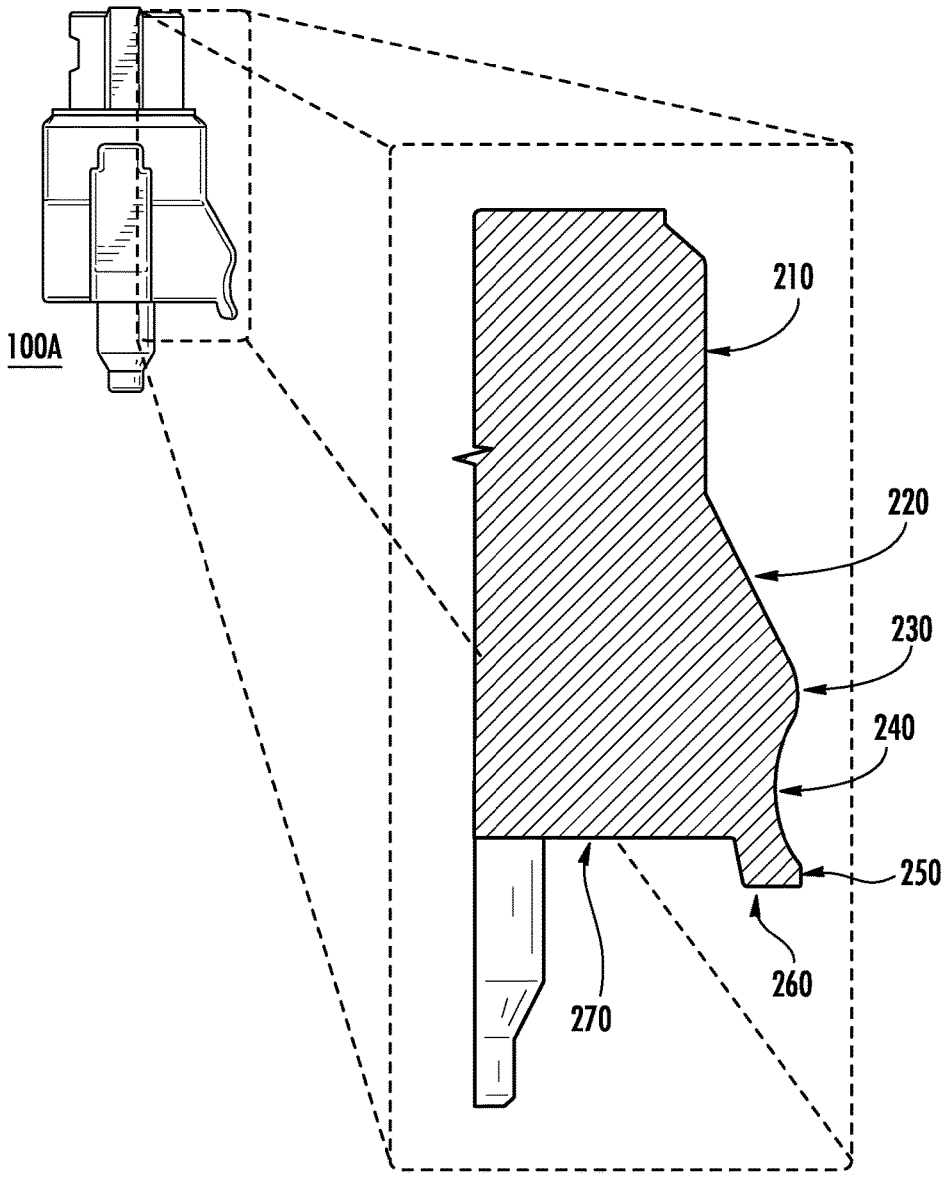
FIG. 2 is an exploded view of the curved profile of the cam of the plunger of of FIG. 1B; and, FIGS. 3A and 3B, are graphs which illustrate force-travel curves of both an ordinary keyboard switch and that of the keyboard switch of FIG. 1A.
Figure 3A:
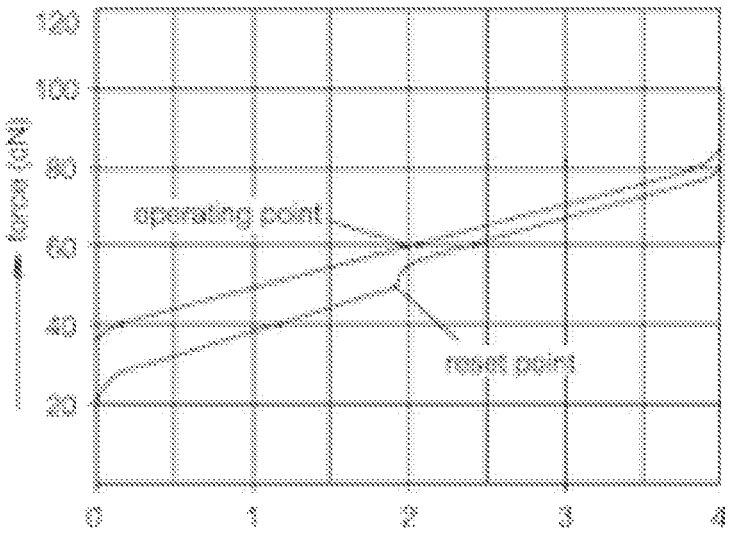
Figure 3B:
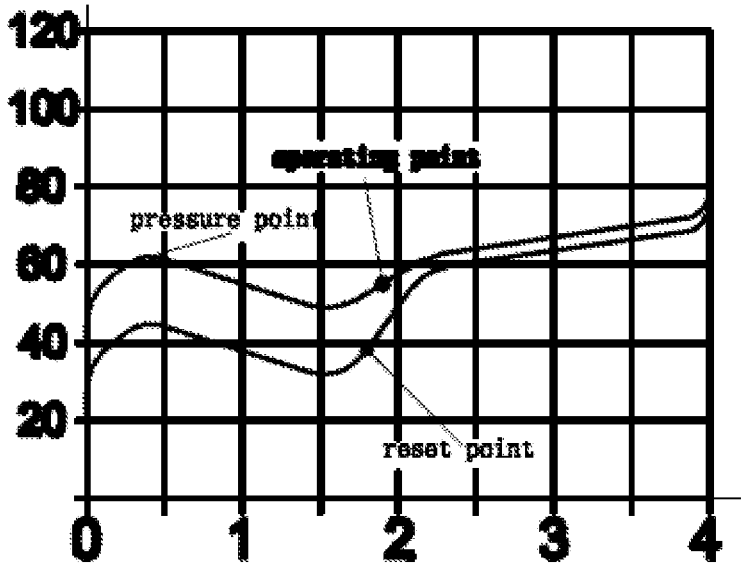

Of import, the plunger further includes at least one cam 200 that extends horizontally from a primary side portion of the body 180. The cam of a typical keyboard switch produces a linear force-travel curve as shown in FIG. 3A. But, the operation of the plunger 100A with cam 200 produces force-travel curve indicative of smooth tactile response as shown in FIG. 3B. The cam 200 is able to produce the foregoing force-travel curve through the curved profile demonstrate by the cam 200 as shown in FIG. 1B which is a side view of a plunger of the keyboard switch of FIG. 1A illustrating a curved profile. More specifically, in reference to FIG. 2, the curved profile of the cam 200 begins with an outward slope 220 from the body 210 at at least one acute angle relative to the primary side portion of the body 210 to a tactile peak 230 at a peak distance from the primary side portion of the body 210, and then continues inwardly from the tactile peak at a constantly changing obtuse angle relative to the primary side portion of the body 210 to a position of no angle 240 relative to the primary side portion of the body 210 and then outwardly from the position of no angle 240 relative to the primary side portion of the body 210 at a constantly changing acute angle relative to the primary side portion of the body 210 to an end position 250 beyond the bottom surface 270 of the plunger 100A and then inwardly towards an interior portion of the bottom surface 270 of the plunger 100A so as to define a tail 260. Importantly, a portion of the curved profile between the tactile peak 230 and the tail 260 define an arc.

Returning now to FIG. 1A, the curved profile of the cam 200 contacts the flexible electrical contactor 150 as the plunger 100A longitudinally moves to the closed position and in contacting the flexible electrical contactor 150, drives the flexible electrical contactor 150 towards the stationary electrical contact 170 until the plunger 100A is at the closed position, during which the flexible electrical contactor 150 continuously contacts the stationary electrical contact 170. In this regard, the flexible electrical contactor 150 may be U-shaped enveloping a top portion of the stationary electrical contact 170 when disposed in the recess 160.

Figure 1C:
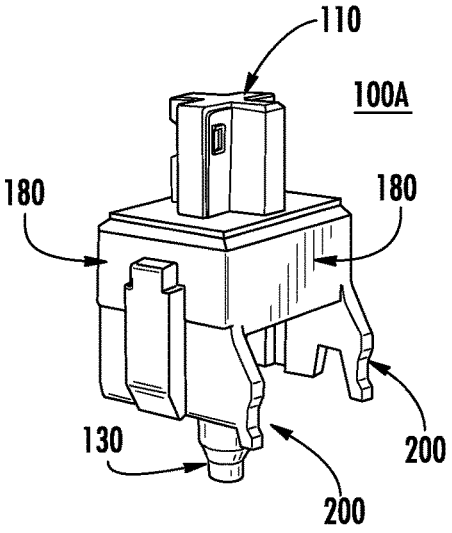
FIG. 1C is a perspective view of the plunger of the keyboard switch of FIG. 1A illustrating dual parallel cams each with a curved profile.

Notably, while only a single cam is shown in connection with FIG. 1A, the plunger 100A in some embodiments may have two or more cams extending from side portions of the body 180. By way of example, FIG. 1C is a perspective view of the plunger of the keyboard switch of FIG. 1A illustrating dual parallel cams 200 each with a curved profile and each extending in parallel to one another from opposite side portions of the body 180 of the plunger 100A. In operation, both cams 200 cooperatively drive different portions of the flexible electrical contactor 150 towards the stationary electrical contact 170 until the plunger 10A is at the closed position.

In another embodiment, an additional flexible electrical contactor (not shown) may be disposed in the base 100B adjacent to an additional stationary contact (not shown) so that the plunger 100A includes two additional cams (not shown) both extending horizontally in parallel to one another from an opposite side portion of the body 180 relative from the primary side portion, each with the curved profile and both cooperatively driving different portions of the additional flexible electrical contactor (not shown) towards the additional stationary electrical contact (not shown) until the plunger 100A is at the closed position.

Of note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

We claim:

1. A keyboard switch comprising:

a plunger secured to a base and adapted to longitudinally move towards the base from an open position to a closed position in which a portion of the plunger drives completion of an electrical circuit of a keyboard matrix, the plunger comprising a body, a cross mount for a key top extending from a top surface of a top portion of the body, a spring guide protruding downwardly from a bottom surface of the top portion of the body and a recess defined within an interior portion of the body adjacent to the spring guide, the base comprising at least an upstanding sleeve extending upwardly from a top surface of a bottom portion of the base and receiving a distal end of the spring guide, a metallic stationary contact comprising a top portion upwardly protruding from the top surface of the bottom portion of the base and a lead downwardly protruding through the bottom portion of the base and extending from a bottom surface of the bottom portion of the base and a flexible electrical contactor extending from the top surface of the bottom portion of the base into the recess of the plunger and positioned within the recess proximate to the top portion of the stationary contact, and a coil spring coiled about an exterior surface of both the spring guide and also the upstanding sleeve and resisting downward longitudinal movement of the plunger and promoting upward longitudinal movement of the plunger, the plunger further comprising at least one cam extending horizontally from a primary side portion of the body, the cam providing a curved profile sloping outwardly from the body at least one acute angle relative to the primary side portion of the body to a tactile peak at a peak distance from the primary side portion of the body, and then inwardly from the tactile peak at a constantly changing obtuse angle relative to the primary side portion of the body to a position of no angle relative to the primary side portion of the body and then outwardly from the position of no angle relative to the primary side portion of the body at a constantly changing acute angle relative to the primary side portion of the body to an end position beyond the bottom surface of the plunger and then inwardly towards an interior portion of the bottom surface of the plunger so as to define a tail, a portion of the curved profile between the tactile peak and the end position defining an arc, the curved profile contacting the flexible electrical contactor as the plunger longitudinally moves to the closed position and in contacting the flexible electrical contactor, driving the flexible electrical contactor towards the stationary electrical contact until the plunger is at the closed position, during which the flexible electrical contactor continuously contacts the stationary electrical contact.

2. The keyboard switch of claim 1, wherein the base is secured to the plunger with hook arms snapping the base into engagement with shoulders formed within grooves of the body of the plunger.

3. The keyboard switch of claim 1, wherein the flexible electrical contactor is a U-shaped flexible electrical contactor enveloping the top portion of the stationary contact.

4. The keyboard switch of claim 1, wherein the plunger comprises two primary cams extending horizontally in parallel to one another from the primary side portion of the body, each with the curved profile and both cooperatively driving different portions of the flexible electrical contactor towards the stationary electrical contact until the plunger is at the closed position.

5. The keyboard switch of claim 4, further comprising an additional flexible electrical contactor adjacent to an additional stationary contact, wherein the plunger comprises two additional cams extending horizontally in parallel to one another from an opposite side portion of the body relative from the primary side portion, each with the curved profile and both cooperatively driving different portions of the additional flexible electrical contactor towards the additional stationary electrical contact until the plunger is at the closed position.

6. A keyboard comprising:

a keyboard matrix; and, a multiplicity of keyboard switches, each of the keyboard switches comprising:

a plunger secured to a base and adapted to longitudinally move towards the base from an open position to a closed position in which a portion of the plunger drives completion of an electrical circuit of the keyboard matrix, the plunger comprising a body, a cross mount for a key top extending from a top surface of a top portion of the body, a spring guide protruding downwardly from a bottom surface of the top portion of the body and a recess defined within an interior portion of the body adjacent to the spring guide, the base comprising at least an upstanding sleeve extending upwardly from a top surface of a bottom portion of the base and receiving a distal end of the spring guide, a metallic stationary contact comprising a top portion upwardly protruding from the top surface of the bottom portion of the base and a lead downwardly protruding through the bottom portion of the base and extending from a bottom surface of the bottom portion of the base and a flexible electrical contactor extending from the top surface of the bottom portion of the base into the recess of the plunger and positioned within the recess proximate to the top portion of the stationary contact, and a coil spring coiled about an exterior surface of both the spring guide and the upstanding sleeve and resisting downward longitudinal movement of the plunger and promoting upward longitudinal movement of the plunger, the plunger further comprising at least one cam extending horizontally from a primary side portion of the body, the cam providing a curved profile sloping outwardly from the body at an acute angle relative to the primary side portion of the body to a tactile peak at a peak distance from the primary side portion of the body, and then inwardly from the tactile peak at a constantly changing obtuse angle relative to the primary side portion of the body to a position of no angle relative to the primary side portion of the body and then outwardly from the position of no angle relative to the primary side portion of the body at a constantly changing acute angle relative to the primary side portion of the body to an end position beyond the bottom surface of the plunger and then inwardly towards an interior portion of the bottom surface of the plunger so as to define a tail, a portion of the curved profile between the tactile peak and the end position defining an arc, the curved profile contacting the flexible electrical contactor as the plunger longitudinally moves to the closed position and in contacting the flexible electrical contactor, driving the flexible electrical contactor towards the stationary electrical contact until the plunger is at the closed position, during which the flexible electrical contactor continuously contacts the stationary electrical contact.

7. The keyboard of claim 6, wherein the base is secured to the plunger with hook arms snapping the base into engagement with shoulders formed within grooves of the body of the plunger.

8. The keyboard of claim 6, wherein the flexible electrical contactor is a U-shaped flexible electrical contactor enveloping the top portion of the stationary contact.

9. The keyboard of claim 6, wherein the plunger comprises two primary cams extending horizontally in parallel to one another from the primary side portion of the body, each with the curved profile and both cooperatively driving different portions of the flexible electrical contactor towards the stationary electrical contact until the plunger is at the closed position.

10. The keyboard of claim 9, further comprising an additional flexible electrical contactor adjacent to an additional stationary contact, wherein the plunger comprises two additional cams extending horizontally in parallel to one another from an opposite side portion of the body relative from the primary side portion, each with the curved profile and both cooperatively driving different portions of the additional flexible electrical contactor towards the additional stationary electrical contact until the plunger is at the closed position.

11. A keyboard comprising a multiplicity of key switches each comprising a plunger coupled to a base and each arranged to permit open-biased actuation of the plunger towards the base so as to cause a cam extending from a side portion of a body of the plunger to drive a flexible electrical contactor into contact with a stationary electrical contact until the plunger is at the closed position, during which the flexible electrical contactor continuously contacts the stationary electrical contact, wherein the improvement comprises:

a curved profile provided by the cam in which the curved profile slopes outwardly from the body at an acute angle relative to a primary side portion of the body to a tactile peak at a peak distance from the primary side portion of the body, and then inwardly from the tactile peak at a constantly changing obtuse angle relative to the primary side portion of the body to a position of no angle relative to the primary side portion of the body and then outwardly from the position of no angle relative to the primary side portion of the body at a constantly changing acute angle relative to the primary side portion of the body to an end position beyond the bottom surface of the plunger and then inwardly towards an interior portion of the bottom surface of the plunger so as to define a tail, a portion of the curved profile between the tactile peak and the end position defining an arc.

* * * * *